US006399904B1

(12) United States Patent
Mimata

(10) Patent No.: US 6,399,904 B1
(45) Date of Patent: Jun. 4, 2002

(54) MULTIPLE CONTACT INPUT DEVICE

(75) Inventor: Yoshihisa Mimata, Yao (JP)

(73) Assignee: Hosiden Corporation, Osaka-fu (JP)

( * ) Notice: Subject to any disclaimer, the term of this patent is extended or adjusted under 35 U.S.C. 154(b) by 0 days.

(21) Appl. No.: 09/119,603

(22) Filed: Jul. 22, 1998

(30) Foreign Application Priority Data

Sep. 30, 1997 (JP) ..... 9-266088

(51) Int. Cl.[7] ..... H01H 25/04
(52) U.S. Cl. ..... 200/6 A; 273/148 B; 200/406
(58) Field of Search ..... 200/4, 5 A, 5 R, 200/6 A, 6 R, 7, 17 R, 5 E, 406, 407, 513; 273/148 B

(56) References Cited

U.S. PATENT DOCUMENTS 2,849,549 A * 8/1958 Elliott ..... 200/6 A
4,408,103 A * 10/1983 Smith, III ..... 200/6 A
4,501,939 A * 2/1985 Hyltin et al. ..... 200/6 A
4,753,000 A * 6/1988 Stearns ..... 29/672
4,913,285 A * 4/1990 Tsutsumi et al. ..... 200/306
5,055,642 A * 10/1991 Miyata ..... 200/293
5,113,047 A * 5/1992 Tsutsumi ..... 200/407
5,621,196 A * 4/1997 Nishijima et al. ..... 200/6 A
5,631,453 A * 5/1997 Maeda ..... 200/6 A
5,665,946 A * 9/1997 Nishijima et al. ..... 200/4
5,689,095 A * 11/1997 Kawase ..... 200/5 R
5,744,765 A * 4/1998 Yamamoto ..... 200/6 A

* cited by examiner

*Primary Examiner*—Renee Luebke
(74) *Attorney, Agent, or Firm*—Jones, Tullar & Cooper, P.C.

(57) ABSTRACT

The present invention relates to a multiple contact input device which makes it possible to use a single operation member in common for the purpose of controlling a coordinate signal and setting a point thereby preventing two switches from simultaneously operating. The device reduces the number of elements of the multiple contact input device. A base is provided with a first switch and four second switches at a periphery of the first switch, and an operation member is provided with a first pressing portion, second pressing members, and projections. When the operation member is swung longitudinally and laterally, the second pressing portions press the second switches. When the operation member is swung diagonally, each projection touches a receiving portion of the base, thereby preventing the second pressing portions from pressing the second switches. When the operation member is pushed, the first pressing portion presses the first switch.

18 Claims, 10 Drawing Sheets

X(XI)
VIII(IX)
1
2
3
12
13
14
15
16
17
18(7)
21
22
23
31
32
33
34
35
43
44
45
S1
S2

MULTIPLE CONTACT INPUT DEVICE

BACKGROUND OF THE INVENTION

1. Field of the Invention

The present invention relates to a multiple contact input device. Especially, the multiple contact input device according to the present invention comprises a first switch operated through a pushing motion of an operation member and a plurality of second switches operated by a swinging motion of the operation member. Such a multiple contact input device is useful as a pointing device employed for navigation systems or the like.

2. Description of the Prior Art

A gazette of Japanese Utility Model Registration No. 2541120 includes a description of a changeover switching device. In the changeover switching device, a circular operation plate is swingingly moved, thereby enabling four switches disposed at four points at intervals of 90° to be selectively operated. In the changeover switching device, a supporting shaft, as a fulcrum for swinging movement, disposed on a center portion of the operation plate, four points at intervals of 90° at a periphery of the supporting shaft have respectively operation portions respectively corresponding to the four switches, and each stopper is disposed between two respective adjacent operation portions. According to a direction of a force applied to the operation plate, the stopper exhibits an effect for interrupting the swinging movement of the operation plate, and such a swinging preventing effect by the stopper can prevent the two switches from being operated simultaneously.

A gazette of Japanese Utility Model Laid-open application No. 6-9025 includes a description of a paddle switch. In this paddle switch, a circular key top plate is swingingly operated, thereby operating selectively four switches arranged at four points at intervals of 90°. Moreover, a hole formed at the center of the key top plate is provided with a key top and the switches disposed on the center portion of the base are operated when the key top is pressed. Moreover, a plate spring is employed so as to return the key top plate to a neutral position and a clicking plate is employed return the key top.

According to the latter application for example, it is possible to output a coordinate signal through a swinging movement operation of the key top plate. Moreover, through the pressing operation of the key top, it is possible to output a point setting signal for generating a determination signal for deciding the previously input coordinate. However, the key top plate and the key top are independently required so as to output the coordinate signal and the point setting signal, thus causing problems such as hindering the number of the parts from being decreased and reducing the operation. Furthermore, according to the latter application, a relatively long guide for guiding a pressing and returning motion of the key top is disposed at a peripheral surface of the hole formed on the key top plate so that a force may be applied to the key top in order to enable the key top plate to be swingingly moved. As a result, it is inconveniently limited to thin a guide.

On the other hand, the noted utility Model Registration makes it only possible to output the coordinate signal by means of the swinging movement operation of the operation plate. However, it makes it impossible to output the point setting signal. Therefore, it cannot be employed as a pointing device used for a navigation system or the like.

SUMMARY OF THE INVENTION

It is an object of the present invention to enable a single operation member to be employed in common for controlling a coordinate signal control and setting a point, thereby easily achieving deletion in the number of components and promotion of a thin device.

It is another object of the present invention to provide a multiple contact input device having a function of preventing two switches from operating simultaneously.

According to the present invention, a multiple contact input device comprises:

a base; a first switch; plural second switches; an operation member; a one-side-member; and other-side-members. The plural second switches are disposed on a plurality of peripheral portions of the base, positioned at regular intervals from the first switch. The operation member includes a first pressing portion for operating the first switch and plural second pressing portions corresponding to the respective second switches. The one-side-member configured as either a projection or a receiving portion arranged at each position between two respective second pressing portions disposed on the operation member and adjacent to each other. The other-side-members configured as either a projection or a receiving portion arranged on the base for touching the one-side-member when the operation member is swung, thereby preventing the two second pressing portions on both sides of the on-side-member from pressing simultaneously the two second switches corresponding thereto.

DETAILED DESCRIPTION OF THE PREFERRRED EMBODIMENTS

General Discussion

Figure 1:
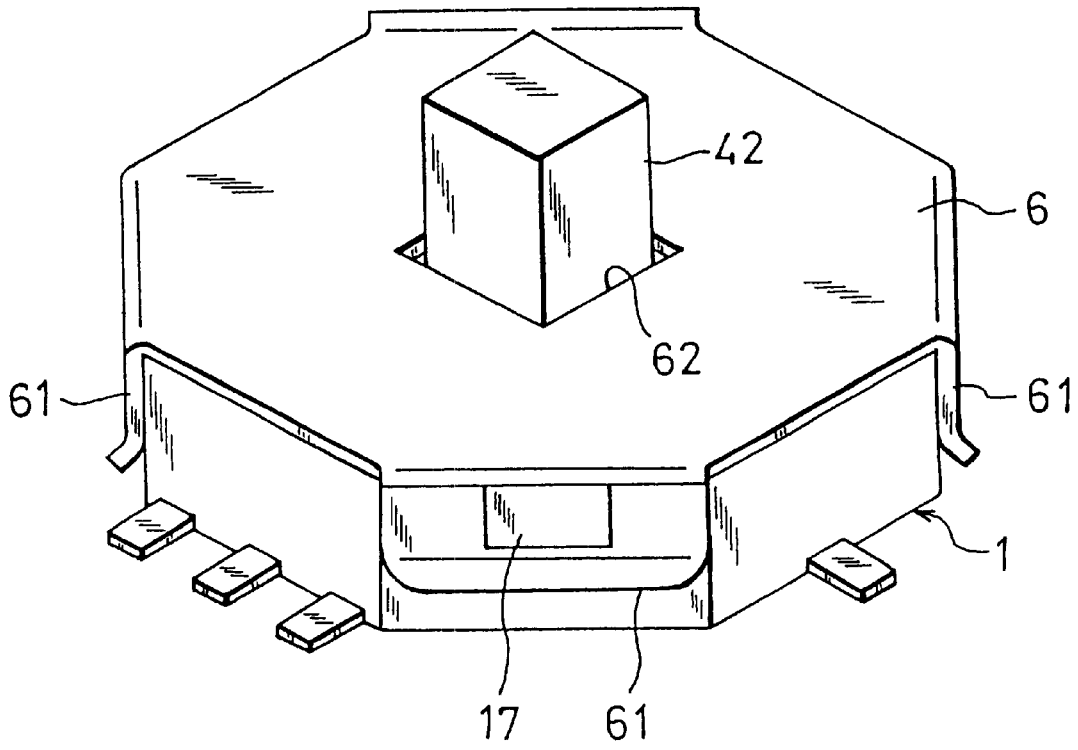
FIG. 1 is a schematic view of an embodiment of the multiple contact input device according to the present invention.

According to the present invention having such an arrangement, the operation member is swingingly moved thereby pressing each second switch corresponding to each second pressing portion via the predetermined second pressing portion with the result that the second switch is switched between an opening state and a closing state. By such a swinging operation of the operation member, for example, a coordinate signal can be output. A pressing force is applied to the operation member, thus pressing the first switch via tie first pressing portion. As a result, the first switch is switched between an opening state and a closing state. By such a pressing operation of the operation member, for example, it is possible to set a point as mentioned above. Next, in case of swinging the operation member, one-side-members (for example, projections) positioned on the operation member which touch the other-side-members (for example, receiving portions) positioned on a base, it is checked that the two adjacent second pressing portions press simultaneously the two second switches corresponding thereto. Therefore, a situation, wherein the two second switches simultaneously are switched between the opening state and the closing state, never happens.

In the multiple contact input device of the present invention, preferably, the first switch is opened or closed through a snapping motion of the first movable portion, and each second switch is opened or closed through a snapping motion of each second movable portion.

According to the multiple contact input device of the present invention, the operation member has a plate-shaped portion, and the plate-shaped portion is provided with the one first pressing portion, the plural second pressing portions and the plural one-side-members.

Preferably, the multiple contact input device comprises a spring member for touching the operation member thereby elastically, and usually pressing, the first pressing portion of the operation member against the first movable portion, and usually, urging the operation member toward a neutral position set at a non-pressing position wherein all the second pressing members do not press the second movable positions.

Also, the spring member may be disposed on another portion. In other words, according to the multiple contact input device wherein a case is formed by the base and a side wall raised on a periphery of the base, the case has a cover body fixed therein, a sheet is applied on an upper surface of the first movable portion and the second movable portion, there may be the spring member between the sheet and the plate-shaped portion of the operation member for elastically urging the operation member toward the cover body, and usually urging the operation member toward a neutral position set at a non-pressing position wherein all second pressing members do not press the second movable positions.

According to the multiple contact input device employing the spring member, when a force is not applied to the operation member, the operation member is urged by the spring member, thereby being kept in a neutral position. Accordingly, the first movable portion of the first switch and the second movable portion of the second switch are kept in a non-pressure state.

Preferably, the multiple contact input device comprises each engaging mechanism for preventing the operation member from axially rotating. For example, in the situation where a case includes the base and a side wall raised on a periphery of the base, each engaging mechanism may be provided with a recess formed on a periphery of the plate-shaped portion of the operation member, and a protrusion formed on the side wall of the case, and engaged with the recess.

In the multiple contact input device according to the present invention, preferably, each second switch comprises:

the rectangular second movable portion having a second normally open contact and second normally closed contacts, the second normally closed contacts made of a plate piece curved opposite to the second normally open contact being disposed on both sides of the second normally open contacts through slits, and both ends in a longitudinal direction of the second normally open contact and the second normally closed contact being connected with each other via each short circuit portion, a second normally closed fixed contact buried in the base and usually touching the second normally closed contacts, and a second normally open fixed contact buried in the base and corresponding to the second normally open contact.

Thus, even if an engagement mechanism for checking an axial rotation of the operation member is provided with play in a rotating direction of the operation member, the second pressing portions of the operation member can ensure usually pressing the second normally open contacts of the second switches. This effect is enhanced by a structure wherein the first switch comprises the circular first movable portion made of a dome-shaped snap plate having a first normally open contact formed the a center portion thereof and a first normally closed contact formed on a peripheral portion thereof, a first normally closed fixed contact buried in the base for usually touching the first normally closed contact, and a first normally open fixed contact buried in the base for corresponding to the first normally open contacts.

Preferably, the second movable portion of the second switch is arranged so as to make a longitudinal direction of the second normally open contact and the second normally close contact correspond to a crossing direction with respect to a radial direction of the first movable portion. Thus, installation spaces of the first switch and the second switches are allowed to be small, thereby availing to promote miniaturizing the multiple contact input device.

The first normally closed fixed contact and the second normally closed fixed contacts may be unified as a common electrode.

In the multiple contact input device, preferably, partitions for dividing a surface of the base into four sections at a periphery of an installation point of the first switch are disposed on four points of the base at intervals of 90° so as to protrude from the surface of the base, and a space surrounded by inner end surfaces of the partitions is allocated to a portion for arranging the first movable portion, and each space between the respective two partitions adjacent to each other in a direction of arranging the partitions is allocated to each portion for arranging the second movable portions. Furthermore, preferably, the one-side-member is the projection, the first pressing portion, the second pressing portion and the projection is subsequently decreased in a projecting length from the plate-shaped portion, while the other-side-member is the receiving member, and the receiving member is formed on the surface of the partition. In this arrangement, the first movable portion of the first switch and the second movable portion of each second switch can be surely disposed on each predetermined position. Moreover, it can be surely conducted to switch each second switch by a swinging operation of the operation member and switch the first switch by a pressing operation at the same time while it is also conducted to prevent the two second switches from switching simultaneously.

The multiple contact input device can employ an arrangement wherein an aperture arranged on the center portion of the cover body is penetrated by an operation rod protruding to the center portion of the operation member, and both the operation rod protrudes to an outer side of the cover body. Preferably, in the second movable portion, the longitudinal ends of the second normally closed contacts and the short circuit portions are bent by a folding line of a boundary portion thereof. In addition, the first movable portion may be formed by overlapping the two snap plates with each other.

As mentioned above, according to the present invention, a single operation member enables respectively the first switch and a number of the second switches to be selectively switched. Therefore, the operation member can be used in common for controlling a coordinate signal and setting a point. In addition, it can provide a multiple contact input device for preventing the two switches from simultaneously operating, and as an effect, it can facilitate miniaturizing and thinning the multiple contact input device.

Other features and effects of the present invention can be illustrated more clearly by following embodiments.

DETAILED DESCRIPTION

Referring now to the drawings, preferred embodiments of the present invention are described below.

As shown in FIGS. 1, 2, and 8 to 11, a case 1 of the multiple contact input device is made of a synthetic resin body integrally including a polygonal (for example, octagonal) base 11 and a side wall 12 raised at a periphery of the base 11. The base 11 of the case 1 is provided with a single first switch 2 and four second switches 3.

Principally referring to FIGS. 3, and 8 to 11, the first switch 2 and the four second switches 3 are described.

The first switch 2 comprises a first normally closed fixed contact 21 located in a center portion of the base 11 and having a surface of the switch which is exposed to an approximately C-shaped, configuration, a first normally open fixed contact 22 located in the base 11, and having a surface exposed on a center portion of the first normally closed fixed contact 21, and a first movable portion 23. The first movable portion 23 is made of a circular dome-shaped snap plate and has first normally closed contact 24 at an outer periphery thereof and a spherical surface-shaped first normally open contact 25 extending upward on a center portion thereof. The first movable portion 23 is mounted on the center portion of the base 11 so that the first normally closed contact 24 may usually touch the first normally closed fixed contact 21, and the first normally open contact 25 is opposed to the first normally open fixed contact 22. The first switch 2 has a structure wherein a top of the first movable portion 23 made of the snap plate is pushed downward, whereby the first normally open contact 25 touches the first normally open fixed contact 22 with a snapping motion, and the normally open fixed contact 22 is connected for to the first normally closed fixed contact 21 via the first movable portion 23, thereby leading to a closed state. When a pressing force against the first movable portion 23 is released, the first normally open contact 25 is separated from the first normally open fixed contact 22 with the snapping motion, the first normally open fixed contact 22 is electrically insulated from the first normally closed fixed contact 21, thereby leading to an opening state. In the switching mentioned above, a sound and a touching sensation are made by the snapping motion of the snap plate.

Figure 6:
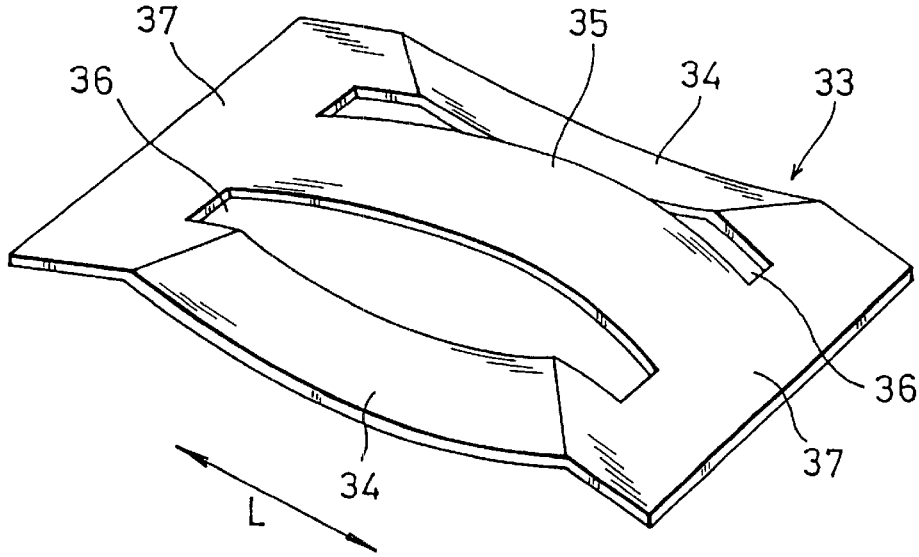
FIG. 6 is a perspective view of a second movable portion.

The second switches 3 are arranged on positions spaced from the first switch 2. Specifically, each second switch includes a second normally closed fixed contact 31 located in the base 11 and having an exposed surface, a second normally open fixed contact 32 located in the base 11 and having an exposed surface and a second movable portion 33. As shown in FIG. 6 in detail, the second movable portion 33 is rectangularly formed. In the second movable portion 33, the second normally closed contacts 34, 34 made of a plate piece curved opposite to a second normally open contact 35 made of a curved plate piece are arranged on both sides of the second normally open contact 35 via slits 36, 36, and longitudinally both end portions of the second normally open contact 35 and the second normally closed contact 34, 34 are connected to each other via short circuit portions 37, 37. Moreover, As shown in an assumption line in FIG. 3, the second movable portion 33 is mounted on the base 11 so that the second normally close contact 34 may usually touch the second normally closed fixed contact 31, and the second normally open contact 35 is opposed to the second normally open fixed contact 32. A top of the second movable portion 33 is pressingly lowered, whereby the second normally open contact 35 touches the second normally open fixed contact 32 with a snapping motion, and the second normally open fixed contact 32 is electrically connected to the second normally closed fixed contact 31 via the second movable portion 33 with the result that the second switch 3 is closed. Moreover, when the pressing force against the second movable portion 33 is released, the second normally open contact 35 is separated from the second normally open fixed contact 32 with the snapping motion and the second usually-opening fixed contact 32 is electrically insulated from the second normally closed fixed contact 31 with the result that it is opened. In switching, as mentioned above, a clicking sound and a touching sensation are made by the snapping motion of the snap plate. As shown in FIG. 6, these clicking sound and touching sensation by the snapping motion of the snap plate are more clearly generated by including a bent folding line on each boundary portion between both longitudinal end portions of each second normally closed contact 34 and each short circuit portions 37.

Figure 3:
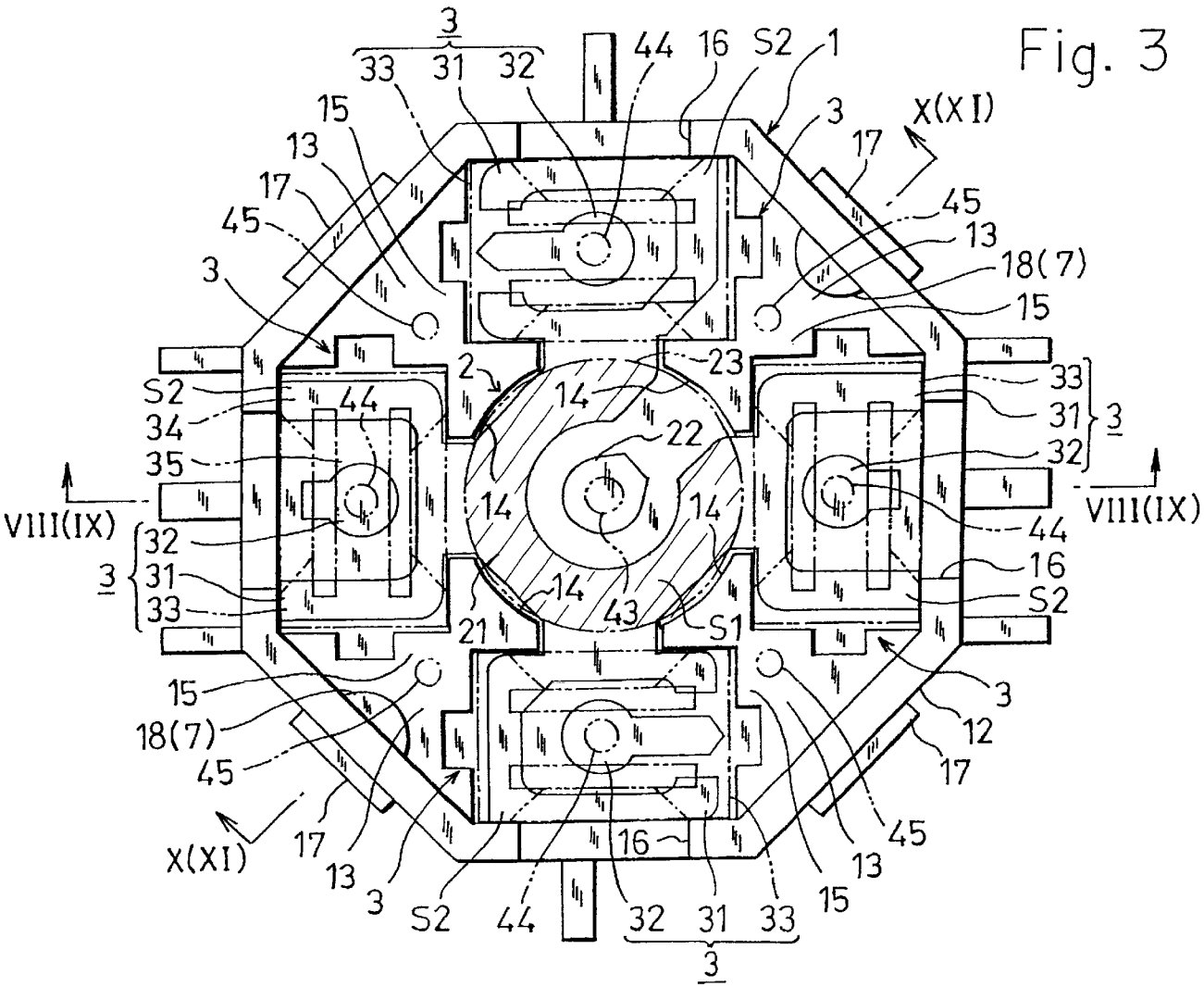
FIG. 3 is a plan view showing the device with an arrangement of switches.
Figure 7:
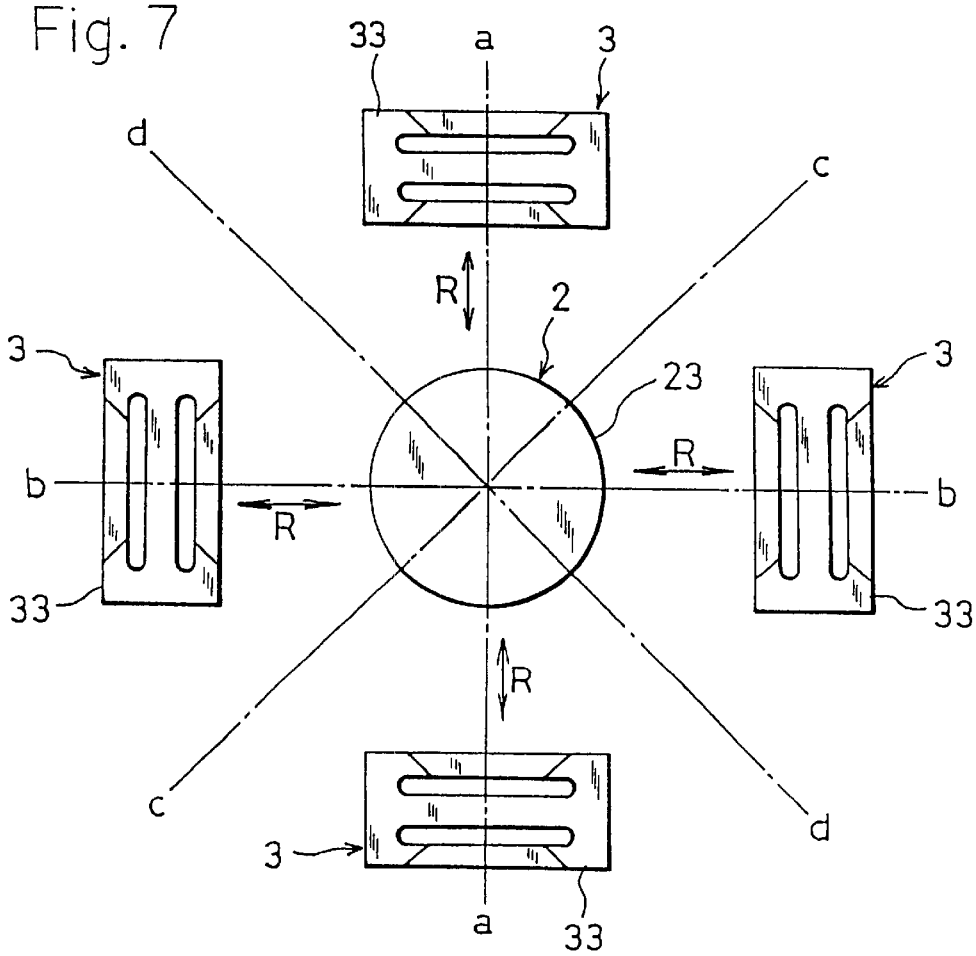
FIG. 7 is a view showing an arrangement of a first movable portion and a second movable portion.

As illustrated in FIGS. 3 and 7, each second switch 3 is disposed on a plurality of peripheral portions positioned at regular intervals from the first switch 2. Namely, the second switches are disposed at four points around the first switch 2 at intervals of 90°. Moreover, each second movable portion 33 of the four second switches 3 is disposed so as to define a longitudinal direction L (cf. FIG. 6) of the second normally open contact 35 and the second normally closed contacts 34 correspond to a crossing direction with respect to a radial direction R of the first movable portion 23 of the first switch 2.

Furthermore, according to the present embodiment, the first normally closed fixed contact 21 of the first switch 2 and the second normally closed fixed contact 31 of each second switch 3 are formed so as to be electrically short circuited by piercing a metal plate, as common electrodes.

Figure 2:
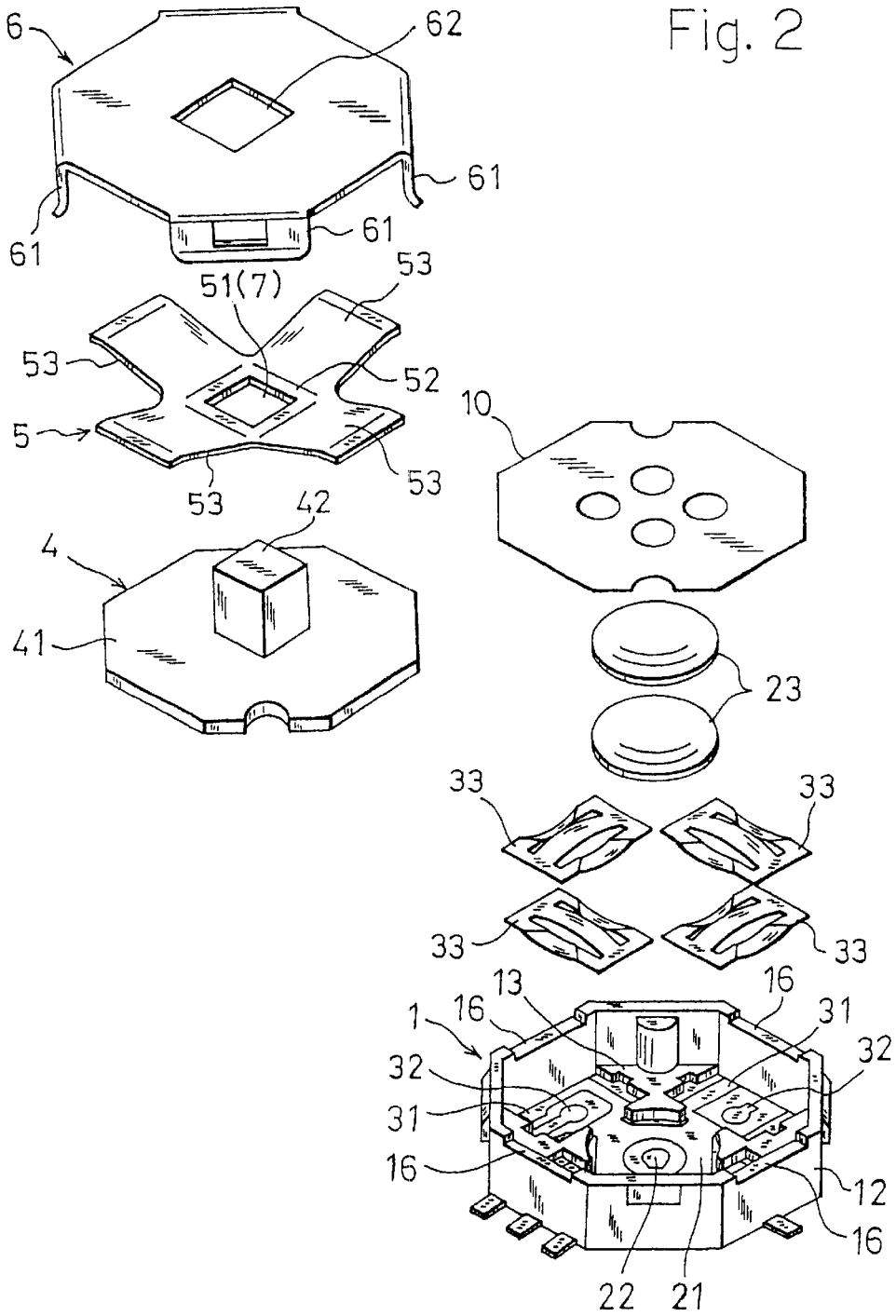
FIG. 2 is an exploded perspective view thereof.

As illustrated in FIGS. 2, 3, 10 and 11, the base 11 of the case 1 is provided with partitions 13 for dividing a surface of the base 11 into four sections at a periphery of an installation point of the first switch 2 so that the partitions 13 may be disposed on four points of the base 11 at intervals of 90° so as to protrude from the surface of the base 11. A space S1 surrounded by an inner end surface 14 of each partition 13 is allocated to a portion for arranging the first movable portion 23. Moreover, each space S2 between two respective adjacent partitions 13 is allocated to a portion for arranging each second movable portion 33. Therefore, the first movable portion 23 is positioned by the respective inner end surfaces 14 of the four partitions 13, and each second movable portion 33 is positioned by the two respective adjacent partitions 13, 13. In FIG. 2, a reference numeral 10 designates an insulating synthetic resin sheet. The sheet 10 is located on an upper surface of the first movable portion 23, the second movable portions 33, the partitions 13 or the like via an adhesive layer, shown in FIGS. 8–12. Thus, the sheet 10 is applied, thereby ensuring relationship of the positions of the first movable portion 23, the second movable portion 33, and the partitions 13. FIG. 12 shows closing of the first normally open fixed contact 22 by a snapping motion of the protruding first pressing portion 43.

Figure 5:
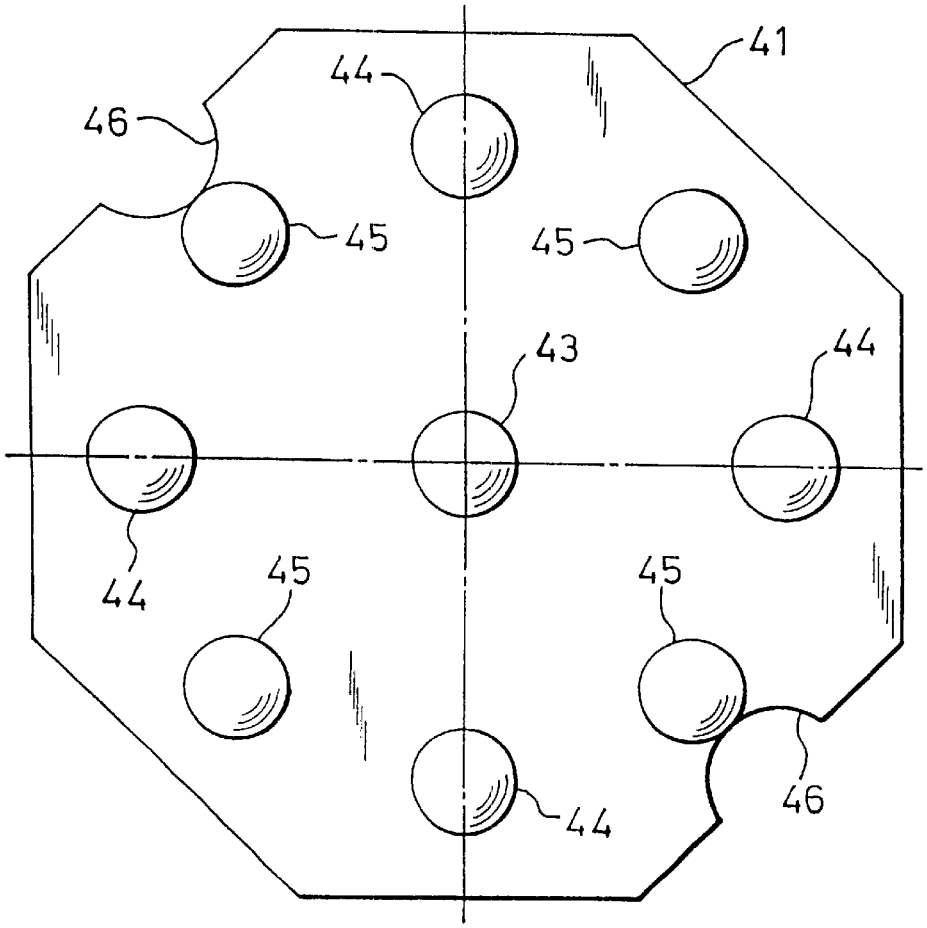
FIG. 5 is a bottom plan view illustrating the operation member of FIG. 4.

The operation member 4 is made of a synthetic resin body integrally including a polygonal (for example, octagonal) plate-shaped portion 41, and an operation rod 42 protruded upwardly from the center portion of the plate-shaped portion 41, and the plate-shaped portion 41 is housed by the case 1. As shown in FIG. 5, a protruding first pressing portion 43 is disposed on a center portion of a back surface of the plate-shaped portion 41. The first pressing portion 43 is supported by the top of the first movable portion 23 of the first switch 2, in a state wherein the sheet 10 is sandwiched therebetween (see FIG. 3). Additionally, the back surface of the plate-shaped portion 41 has protruding second pressing portions 44 at four points at intervals of 90°, equally spaced from the first pressing portion 43. The four second pressing portions 44 respectively correspond to the second normally open contacts 35 of the second movable portions 33 of the second switches 3, in a state of interposing the sheet 10 (see FIG. 3). Moreover, each projection 45 is disposed on a middle portion between the respective two second pressing portions 44, 44 adjacent to each other in a direction of arranging the four second pressing portions 44. The projections 45 disposed at intervals of 90° are opposed to receiving portions 15 formed on the respective surface of the four partitions 13.

Figure 4:
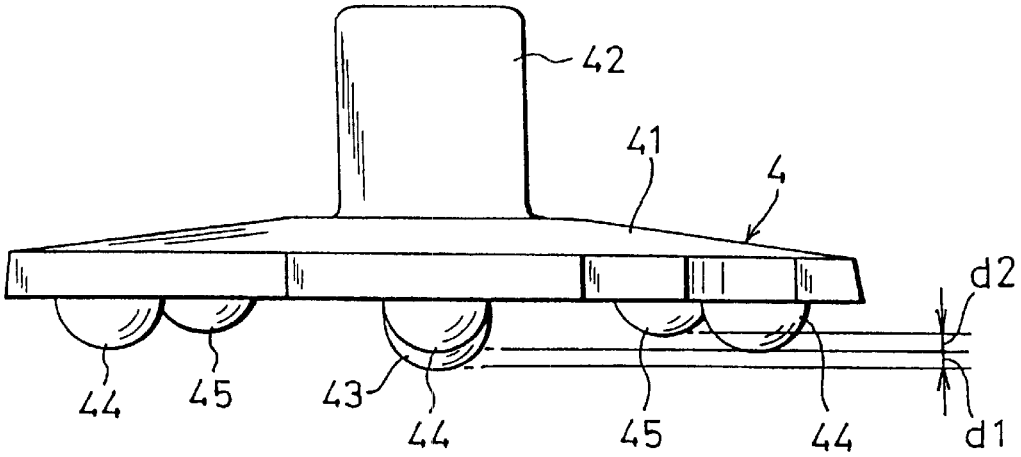
FIG. 4 is a side view of an operation member.
Figure 8:
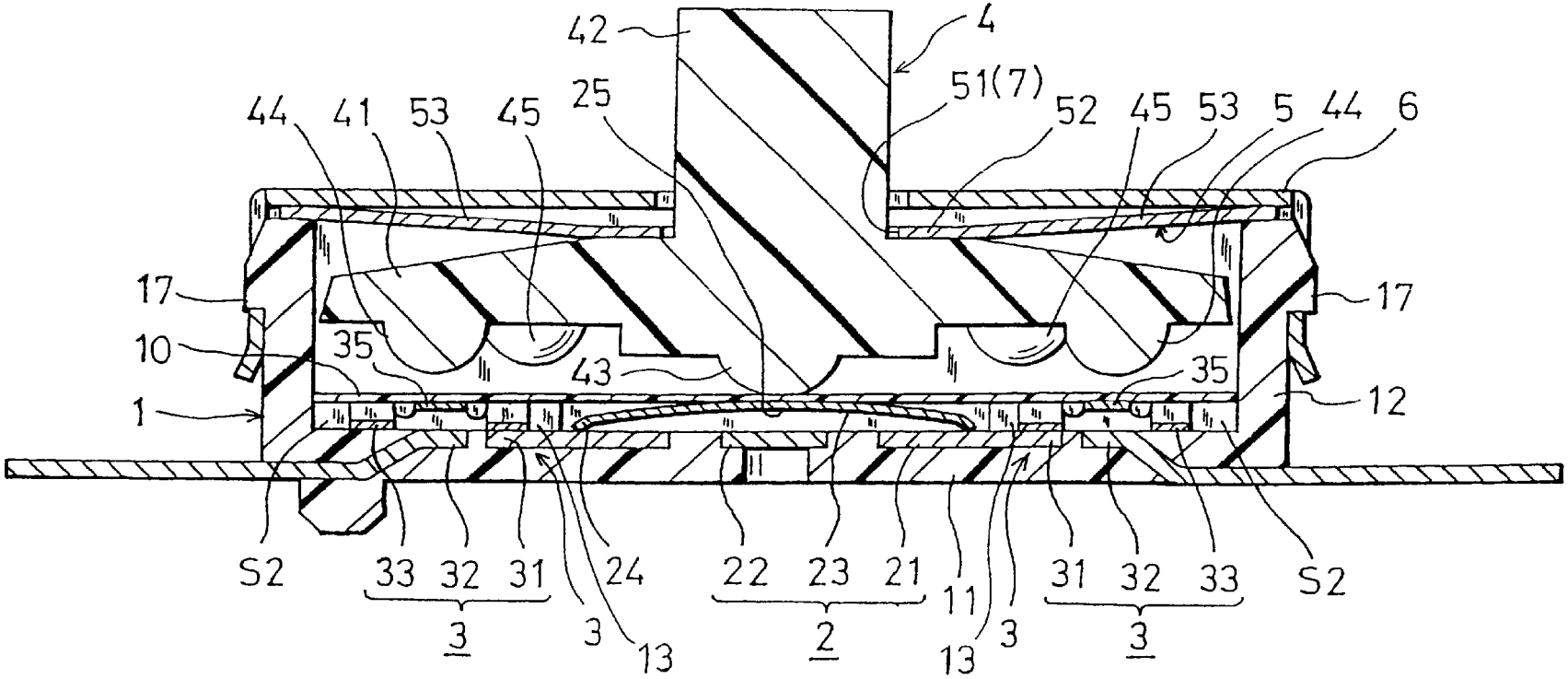
FIG. 8 is a sectional view of FIG. 3 taken along line VIII—VIII for illustrating a non-operating state of the multiple contact input device according to the present invention.

As illustrated in FIG. 4, the first pressing portion 43, the four second pressing portions 44 and the four projections 45 are decreased in that order in a projecting length from the plate-shaped portion 41. Namely, as shown in the same figure, the first pressing portion 43 protudes more to a lower side by only d1 than the second pressing portion 44 and the second pressing portion 44 protrudes to a lower side by only d2 than the projection 45. The difference d1 of a projecting length between the first pressing portion 43 and the second pressing portion 44 is predetermined so as to be equal to a stroke length of the first movable portion 23 made of the snap plate of the first switch 2 or a little more than the stroke length thereof. Therefore, as shown in FIG. 8, even if the operation member 4 is pushed to reverse the first movable portion 23 by means of the first pressing portion 43 when the operation member 4 is in a neutral position (mentioned later), there is no possibility that the second pressing portion 44 makes the second movable portion 33 of each second switch 3 reverse.

Furthermore, a difference d2 of the projecting length between the second pressing portion 44 and the projection 45 is predetermined as below. When the operation member 4 is swingingly moved whereby the single second pressing portion 44 is lowered in a direction of pressingly lowering only the second normally open contact 35 of the second movable portion 33 corresponding thereto, the projection 45 never touches the receiving portion 15 until the second pressing portion 44 makes the second normally open contact 35, reverse completely. However, when the operation member 4 is swingingly moved whereby two second pressing portions 44, 44 adjacent to each other are lowered in a direction of simultaneously pressing the two second normally open contacts 35, 35 of the two second movable portions 33, 33 corresponding thereto, each projection 45 touches the receiving portion 15 with the result that the two second pressing portions 44 makes the two second normally open contacts 35 simultaneously reverse. Thus, the difference d2 is set so as to avoid making the two second pressing portions 44 make the two second usually-opening contacts 35 simultaneously reverse until the projection 45 touches the receiving portion 15.

In FIG. 2, the reference numeral 5 designates a spring member. The spring member 5 includes a center frame portion 52 having an aperture 51 and four arms 53 extending from the center frame portion 52 in a crossing state, a tip of each arm 53 is buried in a recess 16 formed on an upper end surface of the side wall 12 of the case 1, thereby overlapping it with a bottom surface of the recess 16. Furthermore, a reference numeral 6 designates a cover body, the cover body 6 is fixed on the case 1 by engaging an engaging-checking piece 61 disposed on a periphery thereof with an engaging projection 17 on a side of the case 1. The cover body 6 closes an aperture of the case 1 as well as holding the tip of each arm 53 of the spring member 5 in the recess 16. The operation rod 42 of the operation member 4 pierces the aperture 51 of the spring member 5 and a slightly large aperture 62 disposed at the center portion of the cover body 6 thereby protruding to an outer side of the cover member 6. The aperture 51 of the spring member 5 is formed in a square shaped hole, and the operation rod 42 is also formed in a square shape, whereby the aperture 51 of the spring 5 prevents the operation member from axially rotating via the operation rod 42. In addition, recesses 46, 46 (see FIG. 5) formed on two points of the periphery of the plate-shaped portion 41 of the operation member 4 are engaged with two protrusions 18, 18 (see FIG. 3) formed on the side wall 12 of the case 1, thereby preventing the operation member 4 from axially rotating. Therefore, each engaging mechanism 7 for preventing the operation member 4 from axially rotating comprises the recess 46 and the protrusion 18.

The center frame portion 52 of the spring member 5 elastically and lightly presses the plate-shape portion 41 of the operation member 4 downward. Therefore, when a force is not applied to the operation member 4, the pressing force is generated by the spring member 5, thereby keeping the operation member 4 in a neutral position so that an axis thereof is vertical with respect to the base 11.

According to the multiple contact input device mentioned above, in the case that an a pressing operation for pressingly lowering the operation rod 42 is conducted, thereby reversing the first movable portion 23 of the first switch 2 by means of the first pressing portion 43, the first normally open contact 25 touches the first normally open fixed contact 22 to switch the state of the first switch 2 from open to closed. At this time, the touching sensation (the feel) accompanied with the snapping motion of the first movable portion 23 is conveyed to the hand, at the same time while a clicking sound is made. When the pressing force applied to the operation rod 42 is released, the first normally open contact 25 is separated from the first normally open fixed contact 22 accompanied with the snapping motion of the first movable portion 23, thereby switching the first switch 2 from a closed state to an open one. Also, in this case, the touching sensation accompanied with the snapping motion of the first movable portion 23 is conveyed to the hand at the same time while the clicking sound is made.

Figure 9:
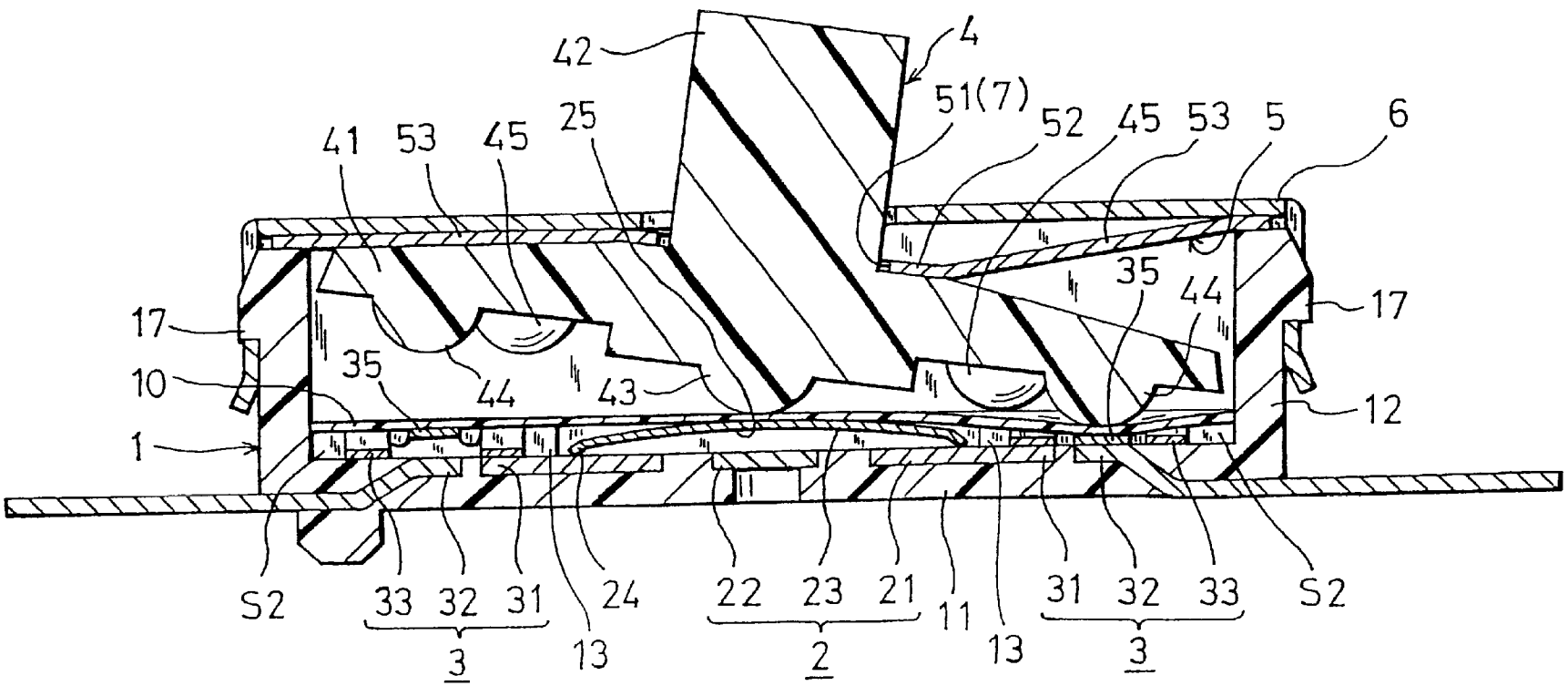
FIG. 9 is a sectional view of FIG. 3 taken along line IX—IX for illustrating an operating state of the multiple contact input device according to the present invention.
Figure 10:
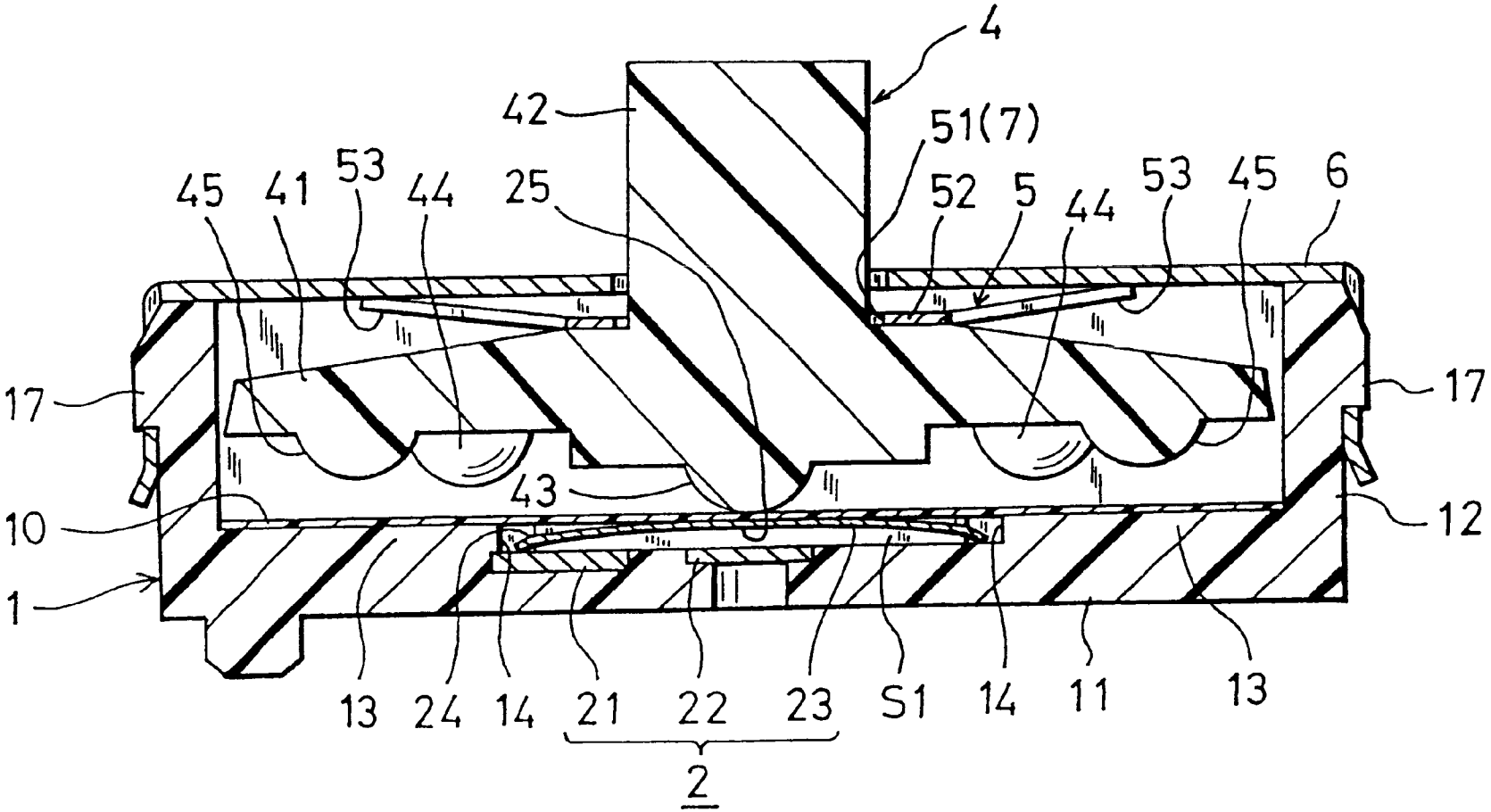
FIG. 10 is a sectional view of FIG. 3 taken along line X—X for illustrating a non-operating state of the multiple contact input device according to the present invention.

From a state wherein the operation member 4 is kept in the neutral position, a swinging movement operation for pressing the operation rod 42 laterally is conducted, thereby swingingly moving the plate-shaped portion 41 in a state wherein the first pressing portion 43 centers thereon. As a result, according to a direction of the swinging movement, as shown in FIG. 9, the predetermined second pressing portion 44 reverses the second normally open contact 35 of the second movable portion 33 of the second switch 3 corresponding thereto, and the second normally open contact 35 touches the second normally open fixed contact 32. Therefore, the second switch 3 is switched from the open state to the closed state. At this time, the touching sensation accompanied with the snapping motion of the second normally open contact 35 is conveyed to the hand at the same time while the clicking sound is made. When a lateral force applied to the operation rod 42 is released, the second normally open contact 35 accompanied with the snapping motion thereof is separated from the second normally open fixed contact 32, thereby switching the second switch 2 from the closed state to the open state. Also, at this time, the touching sensation accompanied with the snapping motion of the second normally open contact 35 is conveyed to the hand, at the same time while the clicking sound is made.

Figure 11:
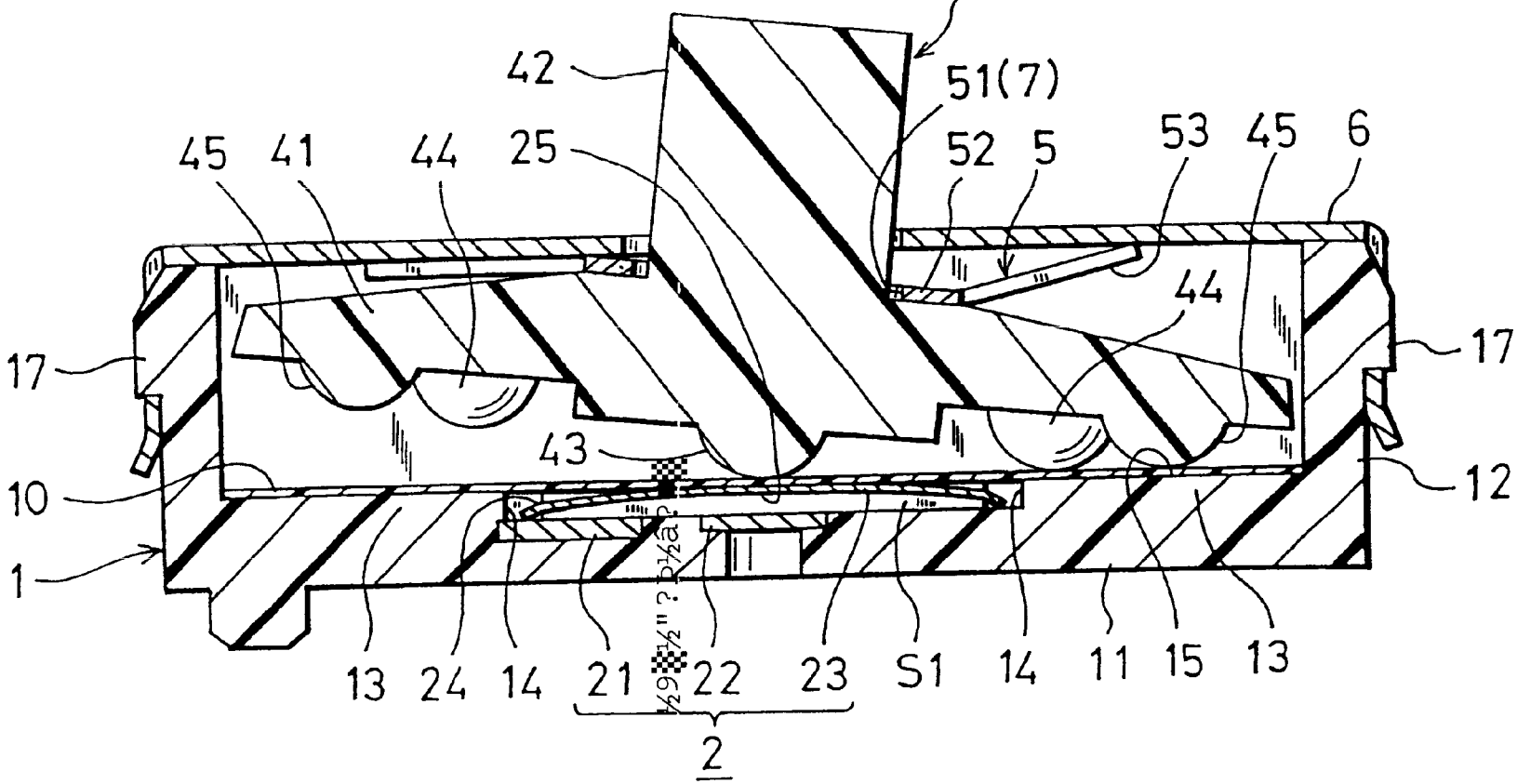
FIG. 11 is a sectional view of FIG. 3 taken along line XI—XI for illustrating an operating state of the multiple contact input device according to the present invention.
Figure 12:
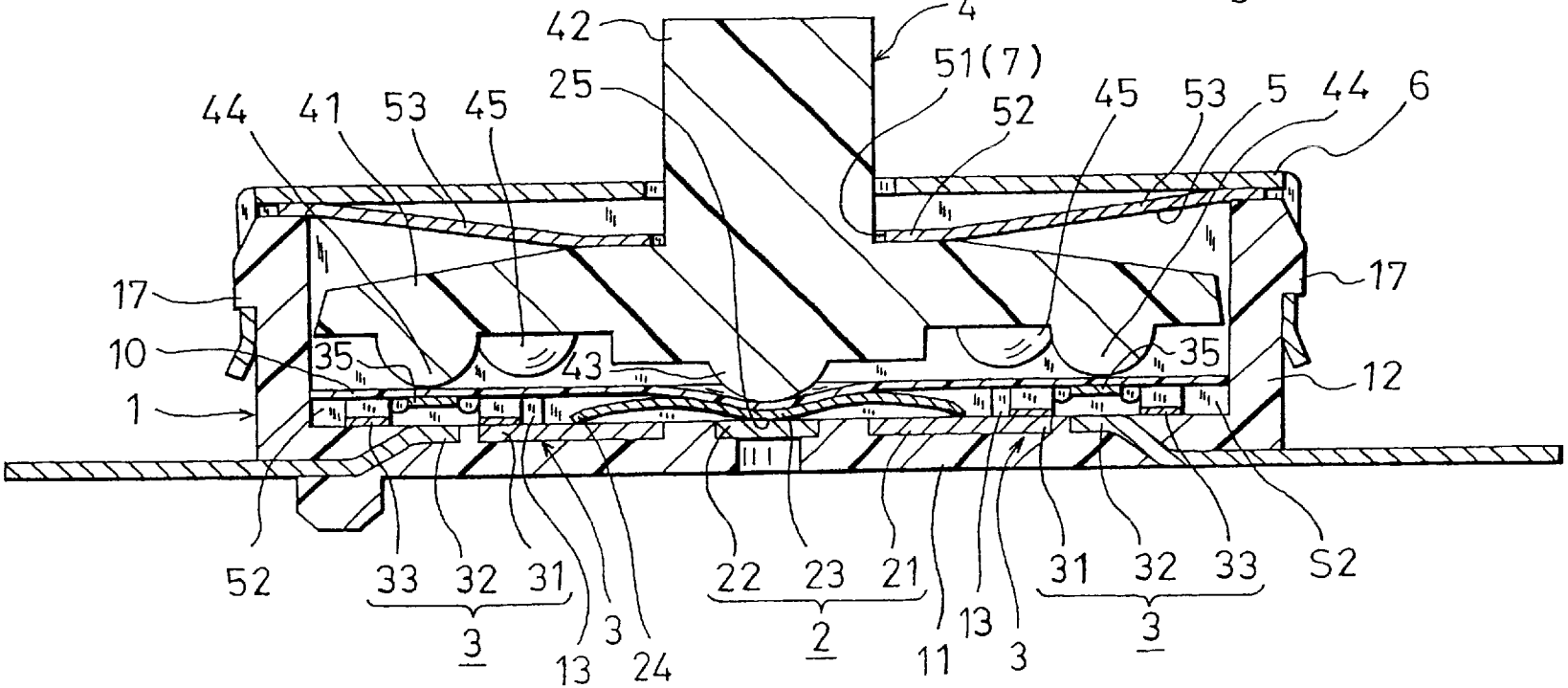
FIG. 12 is a sectional view of FIG. 3 illustrating an operating state of the multiple contact input device according to the present invention.

When the operation rod 42 is laterally pressed, there is a case wherein the projection 45 touches the receiving portion 15 of the partition 13, as shown in FIG. 11. In this case, there is no possibility that the second pressing portions 44, 44 positioned on both sides of the projection 45 simultaneously reverse the second normally open contacts 35 of the second movable portions 33 corresponding thereto. Accordingly, the two second switches 3 are never simultaneously switched from the closed state to the open state. In other words, when the operation member 4 is swingingly moved along the dotted chain lines a—a in a longitudinal direction and b—b in a lateral direction in FIG. 7, the open or closed state of the second switch 3 is changed over according to the swinging movement direction. Then, when the operation member 4 is swingingly moved along dotted chain lines c—c and d—d in diagonal directions in the same figure, the projection 45 touches the receiving portion 15, thereby preventing the two second switches 3, 3 from being switched simultaneously.

Although, in FIG. 2, there is the first movable portion 23 formed by overlapping the two snap plates, the first movable portion 23 may be formed by only one snap plate, needless to say. However, the first movable portion 23 is formed by overlapping the two snap plates, thereby achieving advantages wherein elasticity and strength of the first movable portion 23 is enhanced, and the clicking sound accompanied with the snapping motion is more clearly made at the same time while the touching sensation thereof conveyed to the hand is further clear.

Though, according to the above mentioned multiple contact input device, a crossing shaped plate spring is employed as the spring member, a circular or polygonal (preferably octagonal) shaped plate spring may be employed. Moreover, a position for arranging the spring member 5 is not limited to a portion between the operation member 4 and the cover body 6. Accordingly, it may be interposed between the sheet 10 and the plate-shaped portion 41 of the operation member 4. In this case, the spring member 5 having an upwardly protruding shape can be preferably employed. Moreover, it is also possible that the receiving portion is disposed on the back side of the plate-shaped portion 41 of the operation member 4, and the projection corresponding to the receiving portion is disposed on a side of the case 1.

What is claimed is:

1. A multiple contact input device, comprising:

a base defining a periphery;

a case formed by said base and a side wall extending upwardly from the periphery of said base;

a cover body fixed to said base;

a first movable portion and second movable portions, said first movable portion and said second movable portions each defining an upper surface;

a sheet;

a metallic spring member;

a first switch;

plural second switches disposed on a plurality of peripheral portions of said base, positioned at regular intervals around said first switch;

said base including said first switch and said second switches;

an operation member including a plate-shaped portion, first pressing portion for operating said first switch, and plural second pressing portions corresponding to said respective second switches;

a one-side-member formed as one of: a projection and a receiving portion, arranged at each position between two respective second pressing portions disposed on said operation member and adjacent of each other; and other-side-members formed as one of: a projection and a receiving portion arranged on said base for touching said one-side-member when said operation member is swung, thereby preventing the two second pressing portions on both sides of said one-side-member from pressing simultaneously the two second switches corresponding thereto, wherein said sheet is applied to the upper surface of said first movable portion and said second movable portions, said metallic spring member being situated between said cover and said plate-shaped portion for elastically urging said operation member away from said cover body, and urging with said first switch said operation member toward a neutral position, which is set at a non-pressing position where all said second pressing portions do not press said second movable portions.

2. A multiple contact input device according to claim 1, wherein said first switch is moved to be one: of opened and closed, through a snapping motion of said first movable portion.

3. A multiple contact input device according to claim 1, further comprising: a plurality of second moving portions, wherein said second switches are moved to be one of: opened and closed through a snapping motion of each of said second movable portions.

4. A multiple contact input device according to claim 1, wherein said spring member is made of a plate spring.

5. A multiple contact input device according to claim 1, wherein said plate-shaped portion of said operation member is provided with said one first pressing portion, said plural second pressing portions and said plural other-side-members.

6. A multiple contact input device according to claim 5, wherein said spring member is made of a plate spring.

7. A multiple contact input device according to claim 1, wherein said operation member has a center portion and said cover body has a center portion, and wherein an aperture arranged at the center portion of said cover body is penetrated by an operation rod protruding from said center portion of said operation member, and said operation rod protrudes from an outer side of said cover body.

8. A multiple contact input device according to claim 1, further comprising:

engaging means for preventing said operation member from rotating.

9. A multiple contact input device according to claim 8, wherein said case has a protrusion formed on at least two of its sides, and wherein said engaging means is formed as a recess on a periphery of said plate-shaped portion, said protrusions being engaged with a corresponding recess.

10. A multiple contact input device according to claim 1, wherein said plural second switches are disposed at four points at intervals of 90° on said base, and wherein said other-side-members are disposed at four points at intervals of 90°.

11. A multiple contact input device according to claim 1, wherein said second movable portions are rectangular, and wherein each second switch comprises:

a rectangular second movable portion having a second normally open contact and second normally closed contacts made of a plate piece curved opposite to said second normally open contacts, and disposed on both sides of said second normally open contacts through slits, said second normally open contacts and said second normally closed contacts define longitudinal ends, with both longitudinal ends of said second normally open contacts and said second normally closed contacts being connected with each other via a short circuit portion;

a second normally closed fixed contact situated in said base and touching said second normally closed contacts; and a second normally open fixed contact situated in said base and corresponding to said second normally open contact.

12. A multiple contact input device according to claim 1, wherein said first switch comprises a circular dome-shaped snap plate comprising said first movable portion having a first normally open contact formed at a center portion thereof and a first normally closed contact formed at a peripheral portion thereof; a first normally closed fixed contact situated in said base for touching said first normally closed contact, and a first normally open fixed contact situated in said base corresponding to said first normally open contact.

13. A multiple contact input device according to claim 11, wherein said first switch comprises a circular dome-shaped snap plate comprising said first movable portion having a first normally open contact formed at the center portion thereof, and a first normally closed contact formed at a peripheral portion thereof, a first normally closed fixed contact situated in said base for touching said first normally closed contact, and a first normally open fixed contact situated in said base corresponding to said first normally open contact.

14. A multiple contact input device according to claim 13, wherein said circular first movable portion is formed by overlapping said two dome-shaped snap plates with each other.

15. A multiple contact input device according to claim 13, wherein said first normally closed fixed contact and said second normally closed fixed contact are unified as a common electrode.

16. A multiple contact input device according to claim 13, wherein said base includes partitions for dividing a surface of said base into four sections at a periphery of an installation point of said first switch, and wherein said base defines inner end surfaces and said partitions define inner end surfaces, said partitions being disposed at four points of said base at intervals of 90° so as to protrude from the surface of said base, and a space surrounded by the inner end surfaces of said base, and a space surrounded by the inner end surfaces of said partitions is allocated to a portion for arranging said first movable portion, each said space between two respective partitions adjacent to each other in a direction of arranging said partitions is allocated to each portion for arranging said second movable portions.

17. A multiple contact input device according to claim 16, wherein said one-side-member is a projection, wherein said first pressing portion, said second pressing portion and said projection have a lesser projected length than said plate-shaped portion, while said other-side-member comprises a receiving member, and said receiving member is formed on a surface of said partition.

18. A multiple contact input device according to claim 11, wherein, in said rectangular second movable portion, both longitudinal ends of said second normally closed contact and said short circuit portions are bent along a folding line of a boundary portion thereof.

* * * * *

UNITED STATES PATENT AND TRADEMARK OFFICE

CERTIFICATE OF CORRECTION

PATENT NO. : 6,399,904 B1
DATED : June 4, 2002
INVENTOR(S) : Yoshihisa Mimata

It is certified that error appears in the above-identified patent and that said Letters Patent is hereby corrected as shown below:

Column 10,
Line 26, “of” should be -- to --.
Line 44, “one: of” should be -- one of: --.

Signed and Sealed this

Seventeenth Day of September, 2002

*Attest:*

*Attesting Officer*

JAMES E. ROGAN
*Director of the United States Patent and Trademark Office*